United States Patent [19]

Cotone

[11] Patent Number: 4,875,470

[45] Date of Patent: Oct. 24, 1989

[54] RECIPROCATING ROLLING MASSAGER WITH VARYING PRESSURE AND VARYING WHEEL PLACEMENT

[76] Inventor: Cris A. Cotone, 5708 Buena Vista Ter., Eagle Rock, Calif. 90042

[21] Appl. No.: 183,787

[22] Filed: Apr. 20, 1988

[51] Int. Cl.[4] ..... A61H 15/00; A61H 9/00

[52] U.S. Cl. ..... 128/57; 128/52

[58] Field of Search ..... 128/57, 53, 52, 51, 128/58

[56] References Cited

U.S. PATENT DOCUMENTS

| | | | |
|---|---|---|---|
| 2,889,826 | 6/1959 | Russo | 128/57 |
| 3,003,497 | 10/1961 | Nanes | 128/57 |
| 3,078,843 | 2/1963 | Brisson | 128/52 |
| 3,799,155 | 3/1974 | Gerlich | 128/52 |
| 3,812,846 | 5/1974 | Trout | 128/57 |
| 3,830,233 | 8/1974 | Hill | 128/71 |
| 3,877,422 | 4/1975 | Heuser et al. | 128/57 |
| 3,882,856 | 5/1975 | Heuser et al. | 128/57 |
| 4,167,182 | 9/1979 | Yamamura et al. | 128/57 |
| 4,190,043 | 2/1980 | Thompson | 128/33 |
| 4,230,098 | 10/1980 | Uematsu | 128/57 |
| 4,422,449 | 12/1983 | Hamabe | 128/57 |
| 4,491,127 | 1/1985 | Yamamura et al. | 128/57 |
| 4,586,493 | 5/1986 | Goodman | 128/57 |
| 4,721,100 | 1/1988 | Hengl | 128/57 |

FOREIGN PATENT DOCUMENTS

| | | | |
|---|---|---|---|
| 2166351 | 5/1986 | United Kingdom | 128/57 |

*Primary Examiner*—Paul T. Sewell

*Assistant Examiner*—Tonya Lamb

*Attorney, Agent, or Firm*—Stetina and Brunda

[57] ABSTRACT

An improved body massaging device which is particularly suited to massaging the back and spinal area is disclosed. The device comprises a body supporting surface having an axially reciprocable carriage means positioned generally thereabove. A massaging assembly is attached to and extends downwardly from the carriage means. The massaging assembly includes at least one body contacting means operative to exert pressure upon a human body positioned on the body supporting surface while undergoing axial reciprocation along the length of the subject's spine. The body supporting surface may comprise a standard examining table or any other horizontal surface upon which a human being may lie in a generally prone position. The body contacting means of the massaging assembly may comprise two separate rotatable massage wheels positioned such that one wheel will contact the body on each lateral side of the subject's spine while the subject lies in a prone position on the body supporting surface. The device may include a means for continually or incrementally altering the spacing between such massage wheels during the course of a treatment session. Also, the device may include a separate means for continually or incrementally increasing/decreasing the downward pressure applied by the massaging assembly on the body. High pressure limit switches may be provided to prevent over pressurization of the subject's body.

15 Claims, 2 Drawing Sheets

Fig. 1
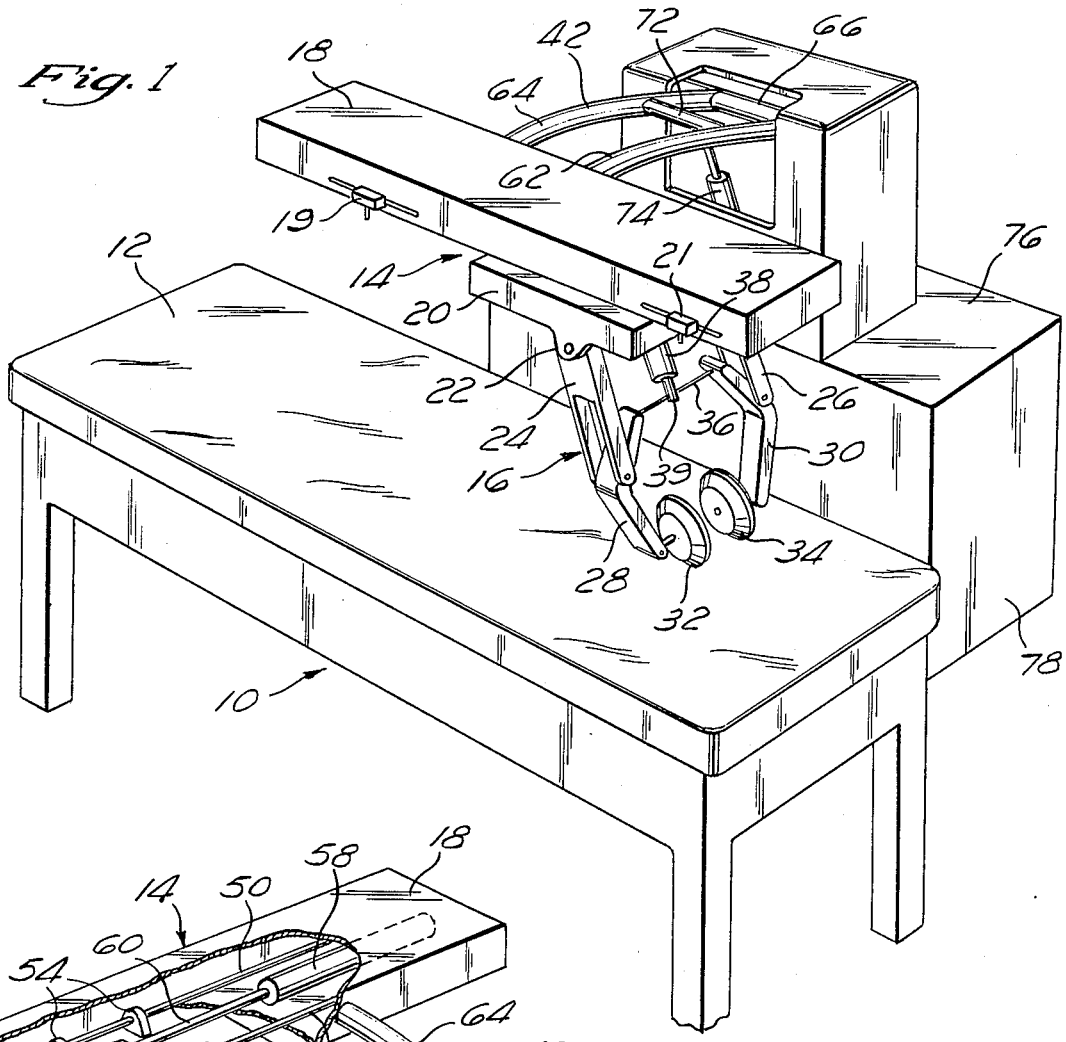
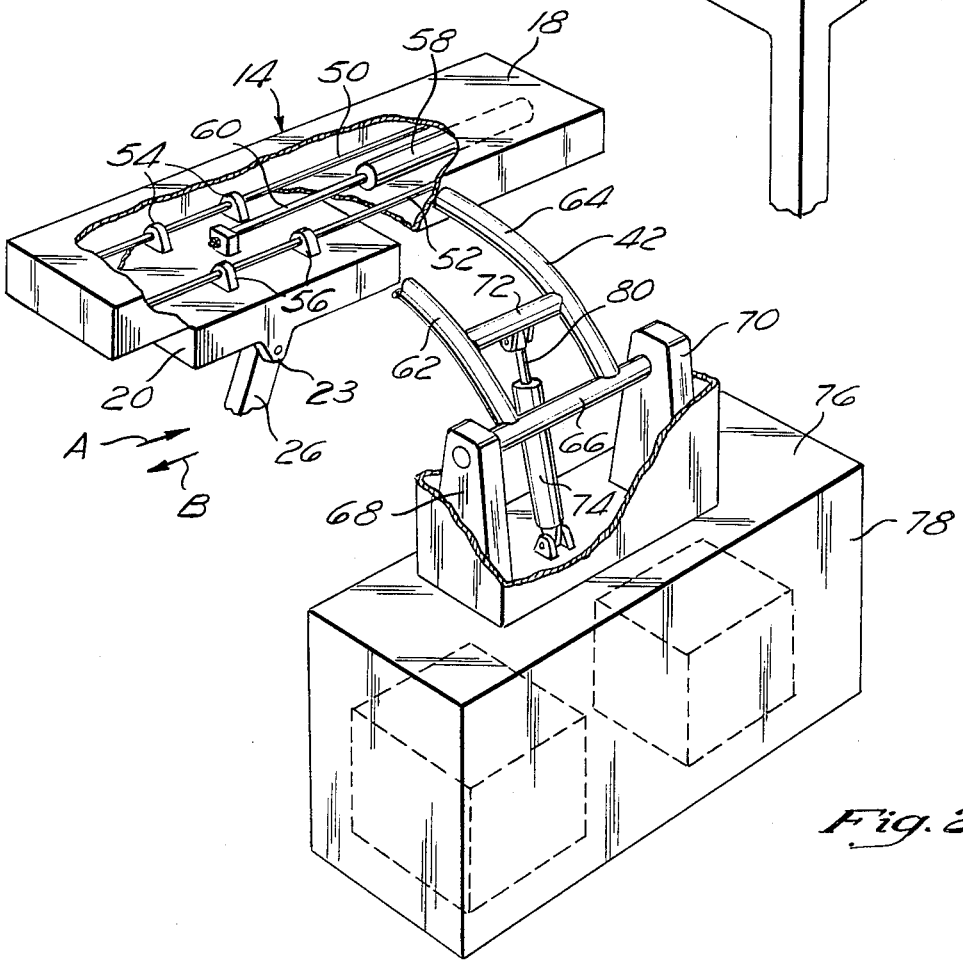
Fig. 2

Fig. 3
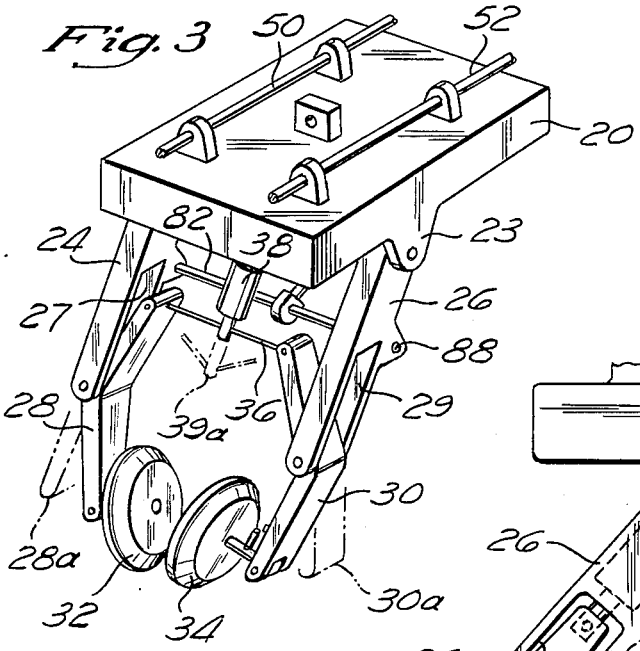
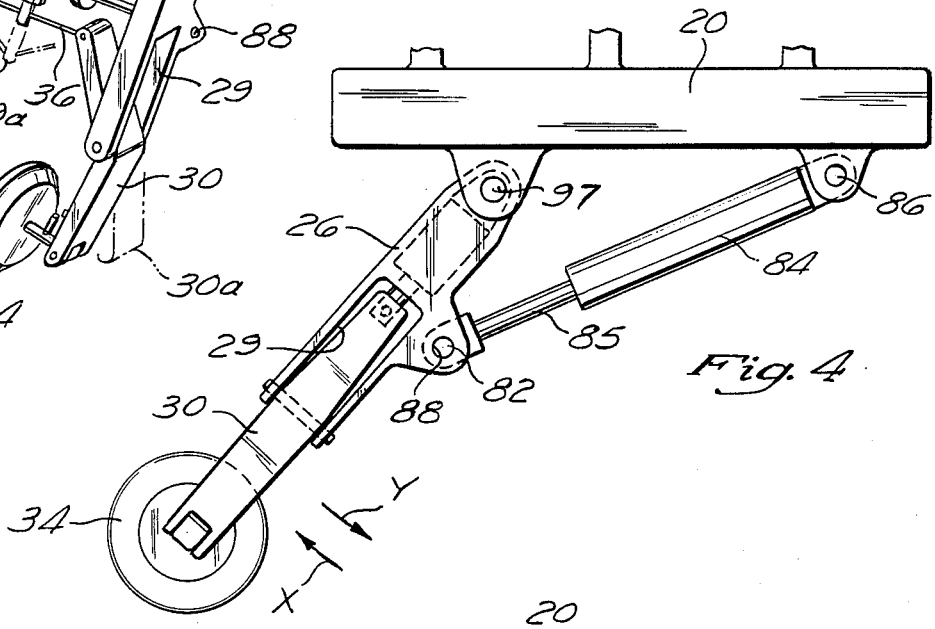
Fig. 4
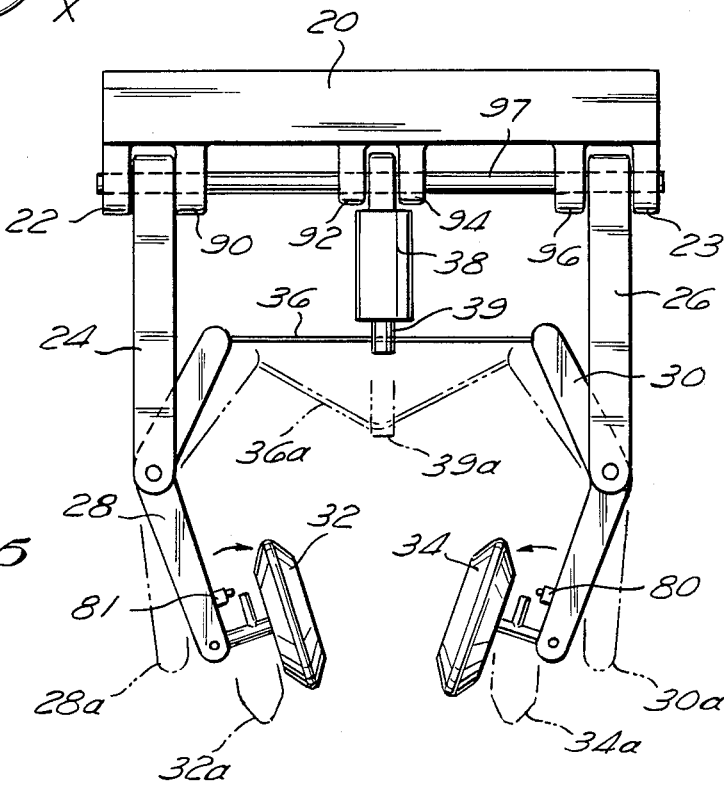
Fig. 5

RECIPROCATING ROLLING MASSAGER WITH VARYING PRESSURE AND VARYING WHEEL PLACEMENT

This invention relates in general to a device for applying therapeutic massage to a portion of the human body. More particularly, the invention relates to a device for applying controlled massage to the spinal area of a human subject while the subject is in a generally prone position on a standard treatment table or other generally flat surface.

BACKGROUND OF THE INVENTION

Numerous body massaging devices are well known in the prior art. Devices for specifically massaging the back and spinal area have included machines wherein the entire massaging apparatus is disposed beneath a body supporting table surface such that massage wheels or other pressure exerting components may apply pressure upwardly, through the table surface, so as to massage the spinal area of a human subject lying in a generally supine position on a table surface.

In many of the prior art devices, the table surface is provided with elastic or flexible panels against which the rollers or other force exerting components may exert their massaging action through the table surface. In other prior art devices, the massage wheels are permitted to protrude upwardly through an elongated aperture within the table surface, so as to directly contact the spinal region of the dorsally recumbant subject.

Examples of spinal massage and manipulation machines of the prior art are found in U.S. Pat. Nos. 3,812,846 (TROUT), 3,830,233 (HILL), 3,882856 (HEUSER ET AL.), 4,190,043 (THOMPSON), 4,491,127 (YAMAMURA ET AL.) and 4,586,493 (GOODMAN).

The present invention provides a significant improvement over these spinal massage machines of the prior art by providing a massage apparatus which may be positioned over the top of a standard examining table such that therapeutic spinal massage may be applied downwardly upon a human subject who is lying in a generally prone position upon the examining table.

BRIEF SUMMARY OF THE INVENTION

In accordance with the present invention there is provided a body massaging device, comprising a body supporting surface having an axially reciprocable carriage means positioned thereabove. A massaging assembly is attached to and extends downwardly from the reciprocable carriage means so as to exert massaging pressure on a desired anatomical portion of the body positioned on the underlying body supporting surface.

Further in accordance with the invention, the reciprocal carriage means of the device may include a stationary overhead housing having at least one slide rail positioned longitudingly therewithin and a slidable mounting block mounted on the slide rail such that the mounting block is reciprocably movable therealong. A propulsion means, such as an electric motor or pneumatic cylinder, is operatively connected to the slidable mounting block so as to slidably move the mounting block along the slide rail in a controlled manner.

In accordance with another aspect of the invention the downwardly extending massaging assembly may include a pair of supporting strut members connected at their upper ends to the slidable mounting block of the overhead carriage means. Such strut members extend generally downward from the slidable mounting block and are joined at their lower ends to at least one body contacting means. Such body contacting means will be sized, positioned and configured to directly contact and massage the underlying body portion as the overhead mounting block slides back and forth. Provided that the human subject has been properly positioned and aligned on the treatment table, the body contacting means of the device may thus exert downward pressure and longitudinal massage of the subject's spine so as to work a desired therapeutic effect on the spinal area.

In accordance with yet another aspect of the invention the body contacting means of the device may consist of one or more rotatable massage wheels positioned on the massaging assembly so as to roll along the underlying body part in accordance with the axially reciprocal movement of the overhead mounting block to which the massaging assembly is attached.

In accordance with the further aspect of the invention the massage machine is provided with a means for adjusting and/or controlling the downward pressure exerted by the massage wheels or other body contacting means. Such pressure adjusting and/or control means may consist of a pneumatic cylinder having a shaft or piston extendable therefrom. The distal end of such pneumatically actuated piston will be connected to the massaging assembly in a manner that will cause greater downward pressure to be exerted as the piston retracts and less downward pressure to be exerted as the piston extends. Additionally, such pneumatically actuated piston or other pressure adjustment and/or control means may be programmed to undergo incremental or continuous movements at specific intervals during the course of a single treatment session. Thus, the downward massaging pressure exerted by the device may be incrementally or continuously increased and/or decreased during the course of a single treatment session. A preferred pattern of controlled pressurization may be characterized by the occurance of incremental extensions of the piston each time the massaging assembly reaches a certain point on its reciprocating longitudinal path. For example, a trip switch may be positioned on one of the slide rails within the overhead carriage means such that each time the longitudinally reciprocating mounting block reaches the end of its longitudinally reciprocating path the trip switch will be actuated. Such trip switch may be operatively to cause an incremental extension of the pneumatic piston each time the trip switch is actuated. Thus, in effect, a small increase in massaging pressure will occur each time the longitudinally reciprocating massaging assembly reaches one end of its longitudinal path.

In accordance with a still further aspect of the invention a device may be provided with one or more pressure limit switches adapted to prevent overpressurization of the underlying human subject. Such pressure limit switches may be built into the massaging assembly such that when the downward pressure on the subjects body exceeds a preset maximum limit, a signal will be sent to the pressure adjusting and/or controlling means which will immediatley trigger reduction in the downward pressure by causing the above described pneumatically activated piston to extend from its pneumatic cylinder.

In accordance with an even further aspect of the invention the massaging assembly may include two separate massage wheels or body contacting means positionable on either side of the subjects spine. Additionally, the massaging machine may be provided with a mechanism for incrementally or continuously changing the distance between such massaging wheels or other body contacting means during the course of a single treatment session. A preferred means by which the distance between the massage wheels or other body contacting means may be regulated is by a separate pneumatic cylinder having a piston extenable therefrom and connected to the massaging assembly in such a manner as to move the massaging wheels or other body contacting means further apart or closer together as the piston extends from/retracts into the pneumatic cylinder. The movement of such piston may be regulated by the controller of the device in accordance with a preset timer or through the use of trip switches positioned within the overhead carriage means and operatively connected to the pneumatic cylinder so as to trigger incremental extensions of the piston each time the massaging assembly reaches a certain point on its reciprocating longitudinal path. For example, a trip switch may be positioned so as to be actuated each time the slidable mounting block of the overhead carriage means reaches one end of its reciprocating longitudinal path. Thus, each time the mounting block comes to the end of its reciprocal path the piston will undergo one incremental movement thereby changing the distance between the massaging wheels by a predetermined distance.

A principal object of the present invention is to provide a device for massaging the spinal area of a human subject while the subject lies in a generally prone position on a standard examining table or other horizontal surface.

A further object of the invention is to provide a massaging device which may be adapted to incrementally or continuously increase and/or decrease the amount of pressure applied to the body of the subject during the course of a single treatment session.

A further object of the invention is to provide a massaging device which will apply downward pressure up to a preset maximum pressure limit. When such preset limit is reached, a control means will be signaled to rapidly or gradually diminish the pressure being applied by the device.

An even further object of the invention is to provide a massaging machine which will concomitantly apply massaging pressure to both lateral sides of the subjects spine. Additionally, the device may be provided with a means for adjusting and/or controlling the massagining assembly such that the distance between pressure application points on either side of the spine will be incrementally or continually increased and/or decreased during the course of a single treatment. Accordingly, the device may be adapted to begin the application of massage pressure a short distance on either side of the subjects spine and to gradually move outwardly such that each of the pressure application will move further away from the spine as the treatment continues. Conversely, the device may be programmed to begin the massage at contact points located some distance from either side of the spine and continuously or incrementally moving inward towards the spine as the treatment progresses.

Further objects and advantages of the invention may become apparent to those skilled in the art upon reading and understanding of the following detailed description of a preferred embodiment and the accompanying drawings.

BRIEF DESCRIPTION OF THE DRAWINGS

In the drawings:

FIG. 1 is a perspective view of a preferred massage machine of the present invention.

FIG. 2 is a cutaway perspective view of a preferred massage machine of the present invention.

FIG. 3 is a perspective view of a portion of a preferred massage machine of the present invention specifically showing the massaging assembly wherby pressure is applied to the human body.

FIG. 4 is a side elevational view of a portion of a preferred massage machine of the present invention.

FIG. 5 is a front elevational view of a portion of a preferred massage machine of the present invention.

DETAILED DESCRIPTION OF THE PREFERRED EMBODIMENT

Referring now to the drawings wherein the showings are for purposes of illustrating a preferred embodiment of the invention and not for purposes of limiting its scope, FIG. 1 provides a perspective view of a preferred massage machine of the present invention positioned over a standard treatment table 10. The treatment table 10 has a generally horizontal upper surface 12 upon which a human subject may comfortably lie in a prone position. An axially reciprocable carriage means 14 is positioned directly above the table 10 and is adapted for reciprocal linear movement parallel to and directly above the approximate longitudinal midline of the body supporting surface 12. A massaging assembly 16 extends downwardly from the overhead carriage means 14 so as to effectively massage the body of a human subject positioned on the surface 12 of table 10.

The carriage means 14 comprises a generally rectangular housing 18 wherein longitudinal slide rails are mounted. A slidable mounting block 20 is disposed on the longitudinal slide rails so as to be slidably moveable therealong. Attachment lugs 22 are positioned on either side of the slideable mounting block 20 so as to permit attachment thereto of the massaging assembly 16.

The massaging assembly 16 comprises a pair of support struts 24 and 26 pivotally connected at their upper ends to the attachment lugs 22, 23 of the slidable mounting block 20 and extending downwardly therefrom. Each support strut 24, 26 is formed in a generally bifurcated or forked configuration having a large central rectangular notch opening 27, 29 at the lower end thereof. Angular connecting members 28 and 30 are pivotally attached to support struts 24 and 26 so as to be pivotally moveable within the rectangular notches 27, 28 of the support struts 24 and 26 as shown.

Padded massage wheels 32 and 34 are attached at the lower ends of the angular connecting members 28 and 30 so as to be positioned on either side of the longitudinal midline of the body supporting surface 12. Accordingly, when a human subject lies squarely on the surface of table 10 the massage wheels will apply downward pressure on either lateral side of the spine.

The upper ends of the angular connecting members 28 and 30 are linked together by a flexible cable 36. A cable deflecting piston 39 is extendable from and retractable into pneumatic cylinder 38. The distal end of piston 39 is connected to the approximate midpoint of cable 36. Extension of piston 39 will cause the cable 36 to deflect downwardly at its approximate midpoint.

Such deflection of cable 36 will cause the top ends of angular connecting members 28 and 30 to be drawn closer together and, as a result, the bottom ends of angular connecting members 28 and 30 will move further apart. Such pivotal movement of the angular connecting members 28 and 30 may thus cause the space between massage wheels 32 and 34 to be continuously or incrementally changed in accordance with the degree of deflection of cable 36.

All of the overhead elements of the device, including the carriage means 14 and the massaging assembly 16 are suspended from a moveable boom 42 The structural and functional interaction between the carriage means 14 and the moveable boom 42 may be clearly appreciated from the cutaway view of FIG. 2.

As shown in FIG. 2, several elements of the carriage means 14 are enclosed within an overhead housing 18. The enclosed elements include a pair of parallel slide rails 50 and 52 which run longitudinally within the rectangular housing 18. A slideable mounting block 20 is slidably disposed on the parallel slide rails 50 and 52 by way of mounting lugs 54 and 56 respectively. The mounting block 20 hangs below the overhead housing 18 and remains longitudinally slidable with respect to the housing 18.

The slidable movement of the mounting block 20 is propelled by pneumatic cylinder 58 which is also positioned within the housing 18. A piston 60 which extends from pneumatic cylinder 58 is distally connected to the slidable mounting block 20 such that retraction of the piston 60 into the pneumatic cylinder 58 will cause the slidable mounting block 20 to move in the direction of arrow A while extension of piston 60 from cylinder 58 will cause the slidable mounting block to move in the direction of arrow B. Accordingly, the mounting block 20 may be reciprocally moved back and forth as desired. The length of such longitudinal movement may be set to correspond with the length of the underlying subjects spine. Thus, the device may be set to apply longitudinal massage reciprocating between the cervial and lumbar or the cervical and sacral spinal regions as desired.

The supporting boom 42 comprises two parallel tubular members 62 and 64 which are welded at their distal ends to the lateral side of housing 18. The proximal ends of tubular members 62 and 64 are perpendicularly joined to a pivotal base cross member 66. The base cross member 66 is pivotally disposed within anchoring piers 68 and 70 so as to firmly anchor the boom 42 within the base housing 78. Also, a cross brace 72 traverses between tubular members 62 and 64 near or slightly distal to the center of gravity of boom 42.

A pneumatic cylinder 74 is firmly mounted on the top panel 76 of base housing 78 such that extension of piston 80 from pneumatic cylinder 74 will exert upward pressure on the cross brace 72 of the supporting boom 42. By such arrangment, extension of the piston 80 from within pneumatic cylinder 74 will cause the supporting boom 42 to swing up and away from the table 10 along an arcuate path dictated by the pivotal movement of base member 66. By such action, the supporting boom 42 may serve to lift the entire carriage assembly 14 and all of its attendant structures, up and away from the examining table surface so as to permit free movement and positioning of the human subject.

Conversely, as piston 80 retracts into pneumatic cylinder 74 the supporting boom 42 will swing downwardly in accordance with the downward pivotal movement of base member 66. Such downward movement of the boom 42 will cause the carriage means 14 and all of its attendant structures to be returned to their operative position directly above the horizontal surface 12 of the examining table 10.

The base housing 78 extends fully to the floor and houses the various mechanical and electrical control components of the device including an air compressor for providing compressed air to the various pneumatic systems as described herein. The mechanical and electrical control components are schematically represented by dotted lines within FIG. 2.

FIG. 3 shows various structures, collectively referred to herein as the "massaging assembly". As shown in FIG. 3, the slidable mounting block 20 of the carriage is slidably disposed upon slide rails 50 and 52. Struts 24 and 26 are attached to the slidable mounting block 20 by way of attachment lugs 23. The angular pivotal connecting members 28 and 30 are independently attached to struts 24 and 26 at the lower ends thereof. The top ends of pivotal connecting members 28 and 30 are joined together by flexible cable 36. Pneumatic cylinder 38, having piston 39 disposed therein, is fixed in angular position on the underside of the slidable connecting block 20 such that the distal end of piston 39 is in contact with and/or attached to flexible cable 36. Thus, as piston 39 extends from cylinder 38 (as shown by phantom lines in FIG. 3) cable 36 will be deflected. Such deflection of cable 36 will cause the top ends of angular connecting members 28 and 30 to be drawn inwardly toward one another. Such inward movement of the top ends of the connecting members 24 and 28 will bring about corresponding outward movement of the bottom ends thereof as shown by phantom lines 28*a* and 30*a*.

Accordingly, as pivotal connecting members 28 and 30 move outwardly to phantom positions 28*a* and 30*a*, the distance between the massage wheels 32 and 34 will increase. Conversely as the pivotal connecting members 28 and 30 move inwardly, the distance between massage wheels 32 and 34 will narrow. Such widening or narrowing may be programmed to occur incrementally or continuously as the treatment continues.

A second pneumatic cylinder (not shown in FIG. 2) is also positioned under the slidable attachment member 20 and is connected to the strut members 24 and 26 by way of crossbar 82. The positioning and function of this second pneumatic cylinder may be more fully appreciated from the side elevational view of FIG. 4.

Referring to FIG. 4, the second pneumatic cylinder 84 is angularly attached at its upper end 86 to the underside of slidable mounting block 20. Piston 85 is slidably disposable within pneumatic cylinder 84 and is distally connected to a crossbar 82. The crossbar 82 is inserted through connecting lug apertures 88 on each of the strut members 26.

Strut members 26 are also attached pivotally to the underside of slidable attachment member 20. Thus, as piston 85 extends from pneumatic cylinder 84, the strut members, along with the remainder of the massaging assembly 16, will swing upwardly in the direction of arrow X. Similarly, as the piston 85 is withdrawn into cylinder 84, the strut members and attendant massage means will swing downwardly as shown by arrow Y. Such upward or downward movement of the massaging assembly will cause the downward pressure exerted by the device to vary correspondingly. Thus, extension of piston 85 will lift the massaging assembly 16 thereby lessening the downward pressure exerted while retracting.

In order to achieve a slow continual increase or decrease in the downward pressure everted by the massage wheels 32 and 34, the pneumatic piston 85 may be moved slowly in either direction, thereby causing each continual change in pressure. Alternatively, incremental changes in pressure may be accomplished by providing a timer or any other type of control means adapted to cause piston 85 to move incrementally into or out of cylinder 84 as the longitudinally reciprocating massage action continues. In the prefered embodiment, such incremental changes may be triggered by one or more switches positioned within the carriage means 14. Such switches may be set to trigger one incremental movement of the piston 85 each time the carriage means 14 reaches a set point on its longitudinally traversing path.

The massage wheels 32 and 34 are downwardly spring biased and are adapted to trip high pressure limit switches 80 when the spring biasing pressure is overcome. When the downward pressure on the massaging assembly 16 exceeds the spring biasing pressure on the massage wheels 32 and 34, the pressure limit switches 80 will be closed. The limit switches 80 will then signal the control means of the device to cause piston immediate retraction of 85 within pneumatic cylinder 84 thereby avoiding overpressurization of the body part being treated.

FIG. 5 is a front elevational view of the massaging assembly. As shown, the slidable mounting member 20 is provided with numerous downwardly extending lugs 22, 90, 92, 94, 96 and 23. Each such lug has a central aperture extending from side to side therethrough. Likewise, the top ends of the struts 24 and 26 and pneumatic cylinder 38 are also provided with analogous apertures sized and configured to directly align with the apertures of mounting lugs 22, 90, 92, 94, 96 and 93. Accordingly, strut 24 is positioned between lug's 22 and 90, strut 26 is positioned between lug's 96 and 23 and the top end of pneumatic cylinder 38 is positioned between lugs 92 and 94. Each of these structures are held in position by retaining rod 96 which is inserted through each of the above described apertures so as hold the strut members 24 and 26 and the pneumatic cylinder 38 in position. While permitting upward and downward pivotal movement for purposes of adjusting the downward massage pressure. Accordingly, movement of piston 39 to its extended position **39*a* causes deflection of cable 36*a*. Such deflection of cable 36*a* in turn causes pivotal adjustment of connecting members 28*a* and 30*a* with resultant widening of the distance between wheels 32*a*, 34*a***.

OPERATION OF THE PREFERRED EMBODIMENT

Refering collectively to FIGS. 1, 2 and 4, the pivotal boom 42 of the device is initially raised by extension of piston 80 from pneumatic cylinder 74 thereby swinging the entire carriage means 14 and massage assembly 16 up and away from the horizontal surface 12 of table 10. A human subject is then positioned in a prone position on the horizontal table surface 12. The boom 42 is subsequently lowered to a point where the carriage means housing 18 is directly above and in general longitudinal allignment with the horizontal surface 12 of table 10. After initiation of the massaging treatment, the downward pressure exerted by the massaging assembly 16 will be controlled by the extension and retraction of piston 85 out of/into pneumatic cylinder 84.

The linear distance of the reciprocal longitudinal travel of the massaging assembly 16 is set to correspond with the length of the spinal region of the patient. This is achieved by manually setting a pair of switch engaging blocks or end stops 19, 21 on carriage means 14 to correspond with the length of the subjects spine to be massaged. Thereafter, piston 60 will retract and extend from cylinder 58 in a reciprocal fashion. Such will result in reciprocating longitudinal travel of massage wheels 32 and 34 over the length of the subjects spine as gauged by the operator when setting the end stops 19, 21.

As the receiprocal lateral movement of the massaging assembly 16 continues, the device will be further programmed to cause incremental extensions of piston 39 from cylinder 38 each time the longitudinally reciprocating carriage means reaches a set point on its longitudinal path. Each such incremental increase in cable deflection will cause the distance between massage wheels 32 and 34 to slightly widen.

Thus, each time the device reaches a set point on its logitudinal traverse, there will (a) occur an incremental widening of the distance between massage wheels 32 and 34 as well as (b) a concomitant increase in downward pressure exerted on the subjects body.

When a pre set maximum downward pressure has been reached, the spring bias of the massage wheels 32 and 34 will be overcome, thereby closing pressure limit switches 80 and 81. This will signal the control means of the device to immediately retract piston 85 into cylinder 84 so as to immediately relieve the downward pressure exerted by the massage wheels 32 and 34 on the spinal area of the human subject. After such events occur the treatment may be reinitiated at a new pressure setting or terminated in accordance with the wishes of the subject or a prescribed treatment plan.

After the treatment has been completed the entire massaging assembly 16 and carriage means 14 will be swung upwardly and away from the table 10 by elevation of boom 42. Thereafter, the patient will be free to ambulate or be carried from the surface 12 of examining table 10.

Although the invention has been described herein with specific reference to a preferred embodiment, it will be appreciated by those skilled in the art that numerous alterations and modifications may be made to such preferred embodiment without departing from the intended scope and spirit of the invention. Accordingly, it is intended that all such alterations and modifications be included insofar as they come within the scope of the appended claims or equivalents thereof.

Having thusly described the invention, what is claimed is:

1. A device for massaging an anatomical portion of the body, said device comprising:

a body supporting surface;

an axially reciprocable carriage means positioned generally above said body supporting surface and operative to reciprocate axially relative thereto;

a massaging assembly attached to and extending downwardly from said carriage means, said massaging assembly including at least one body contacting means operative to exert pressure upon a body portion positioned upon said body supporting surface while reciprocating axially in conjunction with said carriage means;

at least one pressure sensing limit switch operatively associated with the body contacting means, said body contacting means being downwardly biased at a desired maximum pressure limit such that when said maximum pressure limit is exceeded by the device, the downward biasing of the body contacting means will be overcome so as to thereby result in closure of said at least one pressure sensing limit switch.

2. A device for massaging an anatomical portion of the body, said device comprising:

a body supporting surface having a longitudinal axis extending therethrough;

a carriage means positioned generally above said body supporting surface and operative to reciprocate back and forth in generally parallel relation to said longitudinal axis; and a massaging assembly attached to and extending downwardly from said carriage means, said massaging assembly comprising first and second pivotal connecting members having first and second body contacting means mounted respectively thereon;

said first and second pivotal connecting members being operative to pivotally hold said first and second body contacting means in side-by-side juxtaposition such that pivotal movement of said connecting members will result in alteration of the distance between said first and second body contacting means.

3. The device of claim 2 wherein said body supporting surface comprises a treatment table having a horizontal upper surface upon which a human being may lie in a generally prone position such that the first body contacting means will contact the back of the body to the left of the spinal column and the second body contacting means will contact the back of the body to the right of the spinal column.

4. The device of claim 3 wherein said first and second body contacting means comprise first and second massage wheels respectively which roll along either side of the spine in conjunction with the axial reciprocation of said carriage means.

5. The device of claim 4 wherein said first and second body contacting means may be alternately moved further apart and closer together in conjunction with pivotal movement of the pivotal connecting members as the massaging treatment continues.

6. The device of claim 5 further comprising means for causing the pivotal positioning of the pivotal connecting members and the resultant distance between said body contacting means to change by predetermined increments while said axially reciprocating motion continues.

7. The device of claim 5 further comprising a means for causing the pivotal positioning of the pivotal connecting members and the resultant distance between said body contacting means continuously while said axially reciprocating motion continues.

8. The device of claim 2 wherein said carriage means comprises:

an overhead housing;

at least one slide rail positioned longitudinally within said overhead housing;

a slidable mounting block disposed on said longitudinal slide rail so as to be reciprocably moveable therealong;

a propulsion means operatively connected to said mounting block to reciprocally drive said mounting block back and forth along said longitudinal slide rail.

9. The device of claim 1 further comprising means for adjusting the pressure exerted by the first and second body contacting means upon the body portion.

10. The device of claim 9 wherein said means for adjusting the pressure exerted by the first and second body contacting means upon the portion of the body is operative to periodically increase said pressure by predetermined periodic increments while said axially reciprocating massage motion continues.

11. The device of claim 9 wherein said means for adjusting the pressure exerted by the first and second body contacting means upon the portion of the body is operative to continually increase said pressure while said axially reciprocating massage motion continues.

12. The device of claim 2 wherein:

said carriage means is attached to a base housing by way of a moveable boom, said moveable boom being alternately positionable in at least first and second positions;

said first position being an "operative" position wherein said massaging means is positioned directly above said body supporting surface and is capable of exerting downward pressure on a body part positioned on said body supporting surface; and said second position being an "inoperative" position wherein said carriage means and said massaging assembly are held sufficiently far away from said body supporting surface as to facilitate and permit unrestricted positioning of said body portion on said body supporting surface.

13. The device of claim 2 including at least one pressure sensing limit switch operative to prevent overpressurization of the body portion during treatment.

14. The device of claim 13 wherein said pressure sensing limit switch is operatively associated with the body contacting means and said body contacting means is downwardly biased at the desired maximum pressure limit such that when such downward pressure limit is exceeded by the device, closure of said at least one pressure sensing limit switch will result.

15. The device of claim 13 wherein said at least one pressure sensing limit switch is operatively connected to a control means, said control means being operative to relieve the downward pressure exerted by the device in response to closure of said at least one pressure sensing limit switch.

* * * * *